US010741314B2

(12) United States Patent
Kim et al.

(10) Patent No.: US 10,741,314 B2
(45) Date of Patent: Aug. 11, 2020

(54) ANISOTROPIC COMPLEX SINTERED MAGNET COMPRISING MNBI AND ATMOSPHERIC SINTERING PROCESS FOR PREPARING THE SAME

(71) Applicant: LG ELECTRONICS INC., Seoul (KR)

(72) Inventors: Jinbae Kim, Seoul (KR); Yangwoo Byun, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 824 days.

(21) Appl. No.: 15/153,199

(22) Filed: May 12, 2016

(65) Prior Publication Data

US 2016/0314882 A1 Oct. 27, 2016

Related U.S. Application Data

(63) Continuation of application No. PCT/KR2015/006495, filed on Jun. 25, 2015.

(30) Foreign Application Priority Data

Apr. 20, 2015 (KR) ..... 10-2015-0055389

(51) Int. Cl.
*H01F 1/059* (2006.01)
*H01F 1/057* (2006.01)
(Continued)

(52) U.S. Cl.
CPC ..... *H01F 1/0577* (2013.01); *H01F 1/059* (2013.01); *H01F 1/086* (2013.01); *H01F 41/0266* (2013.01)

(58) Field of Classification Search
CPC ..... H01F 1/0577; H01F 1/059; H01F 1/086; H01F 41/0266
(Continued)

(56) References Cited

U.S. PATENT DOCUMENTS 5,238,753 A * 8/1993 Ryoke ..... G11B 5/70 427/130
5,648,160 A 7/1997 Kishimoto et al.
(Continued)

FOREIGN PATENT DOCUMENTS

CN 102360918 A 2/2012
CN 105702444 A 6/2016
(Continued)

OTHER PUBLICATIONS

"A study on the magnetic properties of MnBi magnets fabricated by Spark Plasma Sintering Process", Dec. 2003, pp. 1-82 (88 pages).
(Continued)

*Primary Examiner* — Brian D Walck
(74) *Attorney, Agent, or Firm* — Birch, Stewart, Kolasch & Birch, LLP

(57) ABSTRACT

The present invention relates to an anisotropic complex sintered magnet including MnBi with magnetic characteristics enhanced and an atmospheric sintering method for preparing the same. The anisotropic complex sintered magnet including MnBi according to the present invention may implement excellent magnetic characteristics, and thus may replace rare earth bond magnets in the related art, and a continuous process is enabled because the magnet is prepared by an atmospheric sintering method, and a sintering method used in the permanent magnet process in the related art is used as it is, so that the anisotropic complex sintered magnet is economical.

9 Claims, 3 Drawing Sheets

(51) Int. Cl.
*H01F 41/02* (2006.01)
*H01F 1/08* (2006.01)

(58) Field of Classification Search
USPC ..... 148/301
See application file for complete search history.

(56) References Cited

U.S. PATENT DOCUMENTS

| | | | | |
|---|---|---|---|---|
| 2004/0154699 | A1 | 8/2004 | Chen et al. | |
| 2014/0132376 | A1 | 5/2014 | Jin | |
| 2015/0325349 | A1* | 11/2015 | Gabay | B22F 9/04 335/302 |
| 2016/0035487 | A1 | 2/2016 | Kim et al. | |

FOREIGN PATENT DOCUMENTS

| | | | |
|---|---|---|---|
| JP | 8-138921 | A | 5/1996 |
| JP | 10-335124 | A | 12/1998 |
| JP | 2008-255436 | A | 10/2008 |
| JP | 2008-282959 | A | 11/2008 |
| JP | WO2010/082492 | A1 | 7/2010 |
| KR | 10-2005-0122201 | A | 12/2005 |
| KR | 10-1535487 | B1 | 7/2015 |
| WO | WO 2010/015769 | A1 | 2/2010 |

OTHER PUBLICATIONS

Cao et al., "Magnetic Properties and Thermal Stability of MnBi/NdFeB Hybrid Bonded Magnets," Journal of Applied Physics, vol. 109, No. 17, 2011 (Published online Apr. 11, 2011), pp. 07A740-1 to 07A740-3.

Moon et al., "Synthesis and Magnetic Properties of MnBi(LTP) Magnets with High-Energy Product," IEEE Transactions on Magnetics, vol. 50, No. 11, Nov. 2, 2014, pp. 2103804-1 to 2103804-4.

Rao et al., "Anisotropic MnBi/$Sm_2Fe_{17}N_x$ Hybrid Magnets Fabricated by Hot Compaction," IEEE Transactions on Magnetics, vol. 49, No. 7, Jul. 15, 2013, pp. 3255-3257.

Yang et al., "Magnetic Properties of the Anisotropic MnBi/$Sm_2Fe_{17}N_x$ Hybrid Magnet," Journal of Applied Physics, vol. 115, No. 17, 2014 (Published online Feb. 12, 2014), pp. 17A721-1 to 17A721-3.

Yang et al., "Temperature Dependences of Structure and Coercivity for Melt-spun MnBi Compound," Journal of Magnetism and Magnetic Materials, vol. 330, 2013 (Available online Nov. 5, 2012), pp. 106-110.

Zhang et al. "Magnetic Properties and Thermal Stability of MnBi/SmFeN Hybrid Bonded Magnets", Journal of Applied Physics, vol. 115, 2014, pp. 17A746-1-17A746-3 (3 pages).

* cited by examiner

【Fig. 1】
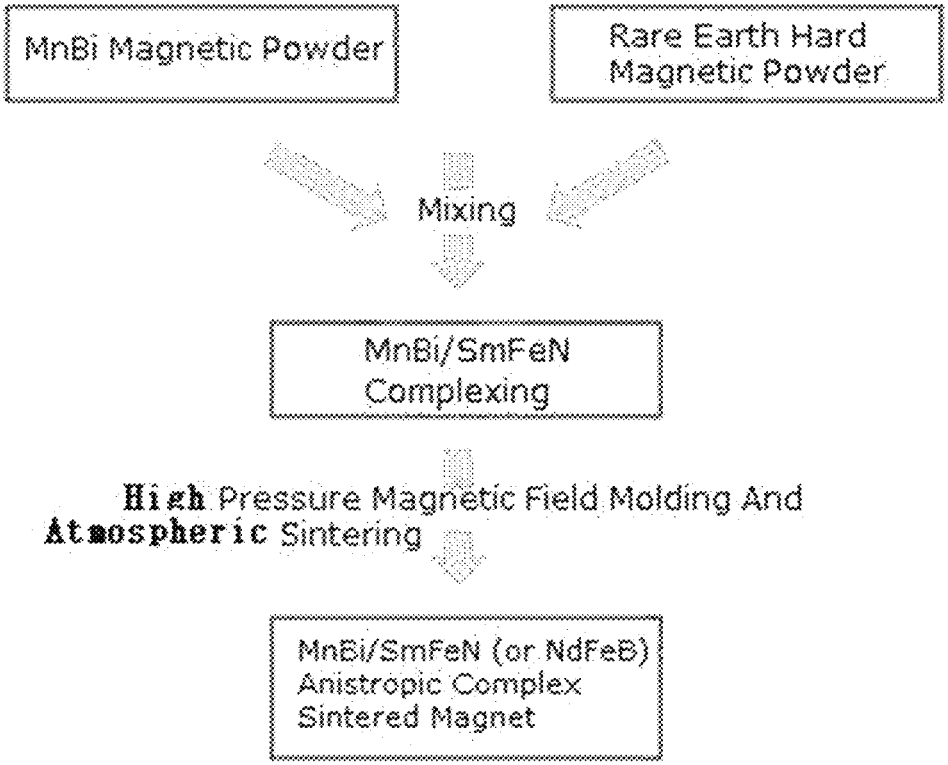
【Fig. 2】
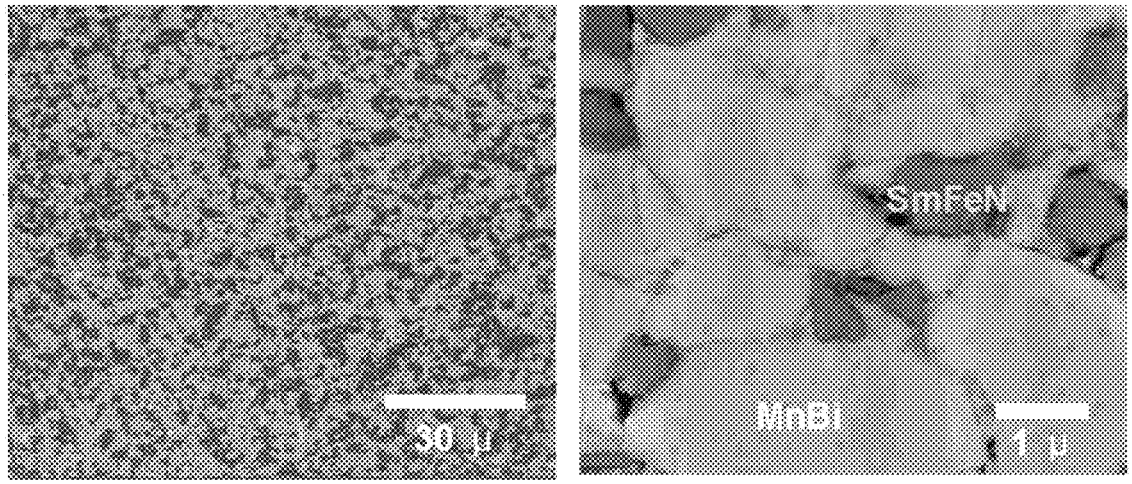

【Fig. 3】
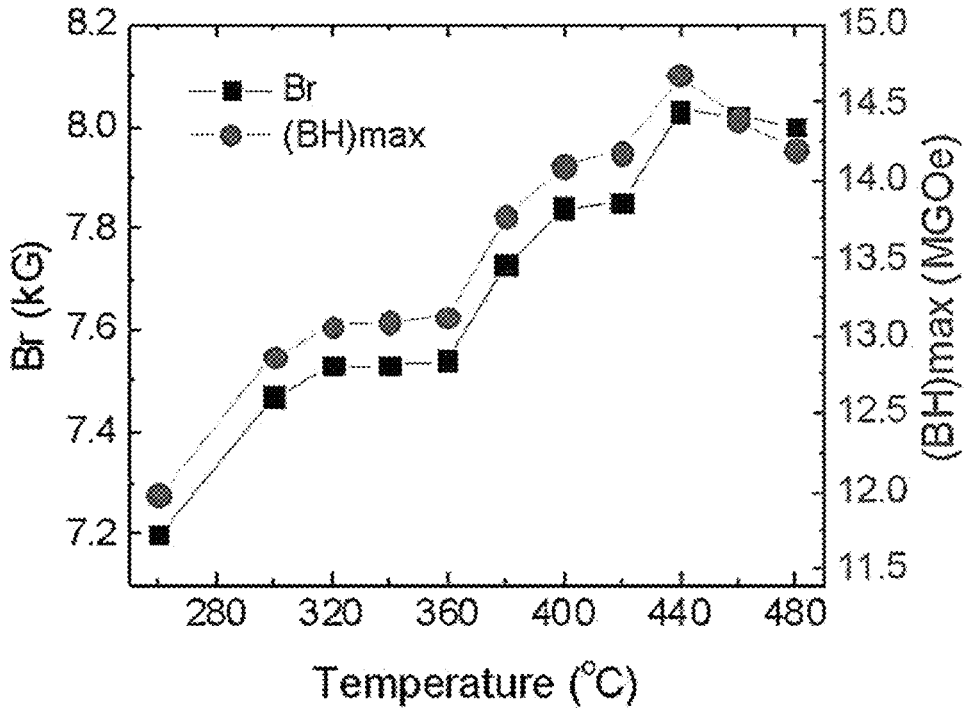
【Fig. 4】
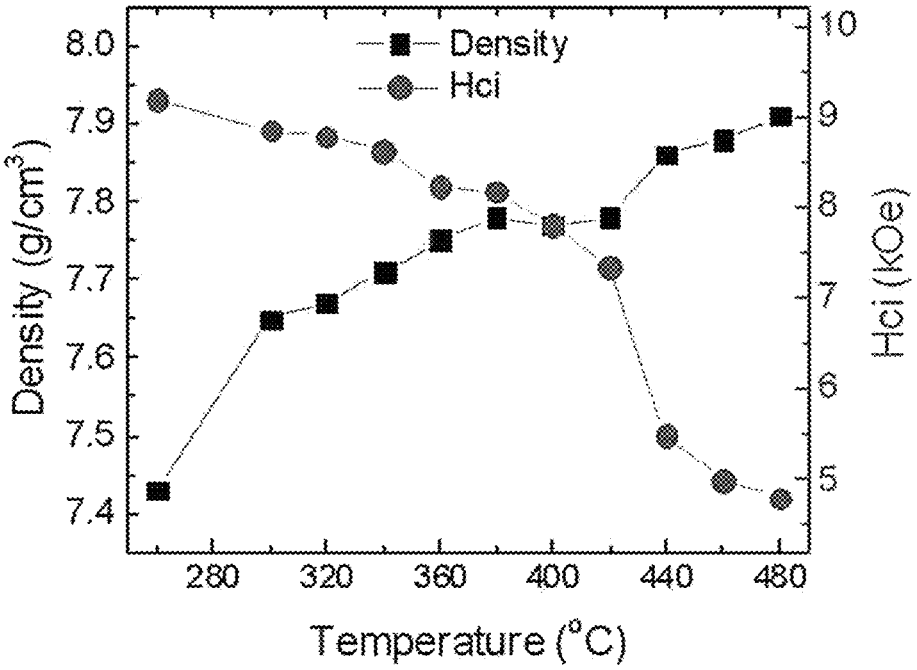

[Fig. 5]
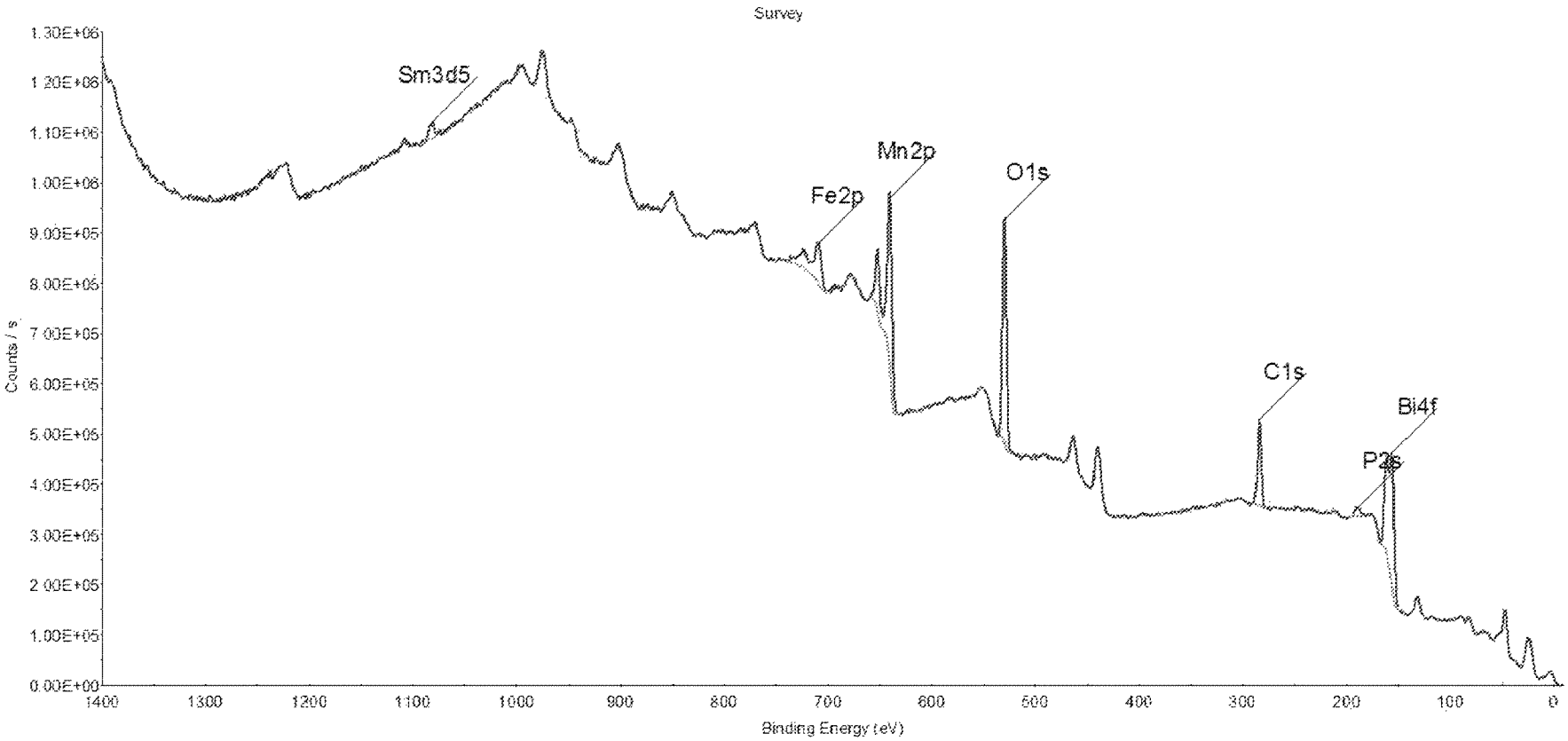

ANISOTROPIC COMPLEX SINTERED MAGNET COMPRISING MNBI AND ATMOSPHERIC SINTERING PROCESS FOR PREPARING THE SAME

CROSS REFERENCE TO RELATED APPLICATIONS

This application is a Continuation of PCT International Application No. PCT/KR2015/006495, filed on Jun. 25, 2015, which claims priority under 35 U.S.C. 119(a) to Patent Application No. 10-2015-0055389, filed in Republic of Korea on Apr. 20, 2015, all of which are hereby expressly incorporated by reference into the present application.

TECHNICAL FIELD

The present invention relates to an anisotropic complex sintered magnet including MnBi and an atmospheric sintering method for preparing the same.

BACKGROUND ART

Neodymium magnets are a molding sintered product including neodymium (Nd), iron oxide (Fe), and boron (B) as main components, and exhibit excellent magnetic characteristics. The demands for these high-performance neodymium (Nd)-based bulk magnets are sharply increasing, but the imbalance problems between demand and supply of rare earth element resources have become a big obstacle to the supply of high-performance motors required for the next-generation industry.

Ferrite magnets have stable magnetic characteristics and are an inexpensive magnet used when a magnet having strong magnetic force is not required, and usually display black. Ferrite magnets have been used for various uses such as D.C motors, compasses, telephones, tachometers, speakers, speedometers, TV sets, reed switches, and clock movements, and are advantageous in lightweight and low prices, but have a problem in that the ferrite magnets fail to exhibit excellent magnetic characteristics capable of replacing expensive neodymium (Nd)-based bulk magnets. Therefore, there is a need for developing a novel high-performance magnetic material capable of replacing rare earth magnets.

MnBi is a rare earth-free material permanent magnet, and has a characteristic of having a larger coercive force than an $Nd_2Fe_{14}B$ permanent magnet at a temperature of 150° C. because the coercive force has a positive temperature coefficient at a temperature interval of −123 to 277° C. Therefore, MnBi is a material suitable for being applied to motors which are driven at high temperature (100 to 200° C.). When compared to other magnets in terms of the $(BH)_{max}$ value which exhibits a magnetic performance index, MnBi is better than ferrite permanent magnets in the related art in terms of performance and may implement a performance which is equal to or more than that of rare earth $Nd_2Fe_{14}B$ bond magnets, and thus is a material capable of replacing these magnets.

Meanwhile, sintering is a heat treatment intended to obtain mechanical and physical properties required for powder molded bodies by heating compressed or uncompressed powder molded bodies at a temperature which is equal to or less than the melting point of a main constituent metal element to allow bonds to be formed by the action of sufficient primary binding force between atoms among powders in the molded bodies which are initially maintained by only a weak binding force. That is, sintering refers to a process in which powder particles are subjected to thermal activation process to become a lump.

The driving force of sintering is to thermodynamically reduce the surface energy of the entire system. Since there is an excess energy at the interface unlike the bulk, the surface energy during the sintering is reduced in a process in which particles are densified and coarsened. The sintering process parameters are temperature, time, atmosphere, sintering pressure, and the like. The process in which particles are sintered generally goes through an initial bonding step in which particles are aggregated with each other to form a neck, a densification step in which blocking of pore channels and spheroidization, shrinkage, and termination of pores proceed, a subsequent coarsening step of pores, and the like.

Methods of sintering a molded body may be largely classified into atmospheric (normal pressure) sintering methods; or pressure sintering methods. Hot-press sintering, hot isostatic pressure sintering, and the like belong to pressure sintering methods. Among these sintering methods, pressure sintering has advantages in that the densification close to nearly 100% may be obtained by minimizing the amount of residual pores in a sample, the mechanical processability is excellent due to the pressurization during the sintering in the initial stage, and densified complex materials may be prepared, whereas the production costs are accordingly increased and the pressure sintering cannot be applied to continuous processes, so that it is difficult for the pressure sintering to be commercialized.

Throughout the present specification, a plurality of documents are referenced, and citations thereof are indicated. The disclosure of each of the cited documents is incorporated herein by reference in its entirety to describe the level of the technical field to which the present invention pertains and the content of the present invention more apparently.

DISCLOSURE OF THE INVENTION

MnBi permanent magnets in the related art have a problem in that the magnet has a relatively lower saturation magnetization value (theoretically ~80 emu/g) than rare earth permanent magnets. Therefore, when MnBi and a rare earth hard magnetic phase such as SmFeN or NdFeB are prepared into a complex sintered magnet, a low saturation magnetization value may be improved. Further, the temperature stability may be secured through the complexing of MnBi having a positive temperature coefficient and the two hard magnetic phases having a negative temperature coefficient for the coercive force. Additionally, a rare earth hard magnetic phase such as SmFeN has a disadvantage in that the rare earth hard magnetic phase fails to be used as a sintered magnet due to a problem in that the phase is decomposed at high temperature (~600° C. or more).

The present inventors have found that in preparation of a complex magnet including MnBi and a rare earth hard magnetic phase, if an MnBi ribbon is prepared by a rapidly solidification process (RSP) to form an MnBi microcrystalline phase, it becomes possible to sinter together with a rare earth hard magnetic phase, which is usually difficult to sinter below 300° C., and thereby an anisotropic sintered magnet can be prepared through the complexing of MnBi powders and a rare earth hard magnetic phase powders; and that such prepared anisotropic sintered magnet gets to have excellent magnetic characteristics.

Furthermore, the present inventors have successfully provided a technology of preparing an anisotropic complex sintered magnet of MnBi/rare earth hard magnetic phases by using an economical atmospheric (normal pressure) sintering method, in order to solve the problems of pressure sintering method which is difficult to be practically used, due to the increase in costs and the difficulties in applying pressure to continuous processes.

Therefore, an object of the present invention is to provide an anisotropic complex sintered magnet including MnBi phase particles and rare earth hard magnetic phase particles.

Another object of the present invention is to provide a method for preparing an anisotropic complex sintered magnet including MnBi phase particles and rare earth hard magnetic phase particles by an atmospheric sintering method.

The other objects and advantages of the present invention will be more apparent from the following detailed description, claims and drawings of the invention.

To achieve these and other advantages and in accordance with the purpose of the present invention, as embodied and broadly described herein, there is provided an anisotropic complex sintered magnet including MnBi phase particles and rare earth hard magnetic phase particles, which comprises carbon residue in the interface between the particles.

In the anisotropic complex sintered magnet of the present invention, the content of the MnBi phase and the rare earth hard magnetic phase may be controlled, thereby adjusting the intensity of coercive force and the size of magnetization value, and in particular, this is a method which is advantageous in producing a high-performance magnet having a uniaxial anisotropy through a uniaxial magnetic field molding and sintering process.

The carbon residue means a carbonized residual substance formed when a sample is evaporated and thermally decomposed. The carbon residue can be detected in the interface between the particles in the complex sintered magnet of the present invention, because lubricant components used in the process of mixing the MnBi phase powders and the rare earth hard magnetic phase powders remain at the interface between the particles.

The composition of the MnBi phase particles included in the anisotropic complex sintered magnet of the present invention may be a composition in which when MnBi is represented by $Mn_xBi_{100-x}$, X is 50 to 55, and may have preferably a composition of $Mn_{50}Bi_{50}$, $Mn_{51}Bi_{49}$, $Mn_{52}Bi_{48}$, $Mn_{53}Bi_{47}$, $Mn_{54}Bi_{46}$, and $Mn_{55}Bi_{45}$.

The rare earth hard magnetic phase included in the anisotropic complex sintered magnet of the present invention may be represented by —CO, R—Fe—B, or R—Fe—N (here, R is a rare earth element selected from the group consisting of Sc, Y, La, Ce, Pr, Nd, Pm, Sm, Eu, Gd, Tb, Dy, Ho, Er, Tm, Yb, and Lu), and may be preferably SmFeN, NdFeB, or SmCo.

In an exemplary embodiment, the magnet of the present invention may include MnBi as a rare earth-free hard magnetic phase in an amount of 55 to 99 wt %, and may include a rare earth hard magnetic phase in an amount of 1 to 45 wt %. If the content of the rare earth hard magnetic phase exceeds 45 wt %, there is a disadvantage in that it is difficult to perform the sintering.

In a preferred exemplary embodiment, when SmFeN is used as the rare earth hard magnetic phase, the content may be 5 to 40 wt %.

An anisotropic complex sintered magnet including the MnBi of the present invention as described above may be widely used for a motor for a refrigerator and air-conditioner compressor, a washing-machine driving motor, a mobile handset vibration motor, a speaker, a voice coil motor, the determination of the positions of a hard disk head for a computer by a linear motor, a zoom, an iris diaphragm, and a shutter of a camera, an actuator of a micromachining system, an automotive electrical part such as a dual clutch transmission (DCT), an anti-lock brake system (ABS), an electric power steering (EPS) motor, and a fuel pump, and the like.

Another aspect of the present invention is to provide an atmospheric sintering method for preparing an anisotropic complex sintered magnet including MnBi, the method including: (a) preparing an MnBi-based ribbon by a rapidly solidification process (RSP); (b) subjecting the prepared non-magnetic phase MnBi-based ribbon to heat treatment to be converted into a magnetic phase MnBi-based ribbon; (c) pulverizing the prepared magnetic phase ribbon to prepare an MnBi hard magnetic phase powder; (d) mixing the MnBi hard magnetic phase powder with a rare earth hard magnetic phase powder in the presence of a lubricant; (e) subjecting the mixture to magnetic field molding while applying external magnetic field and pressure thereto; and (f) subjecting the molded product to atmospheric sintering process.

(a) Process of Preparing MnBi Ribbon by Rapidly Solidification Process (RSP)

The rapidly solidification process (RSP) is a process which has been widely used since 1984, and means a process of forming a solidified micro structure through a rapid extraction of heat energy including superheat and latent heat during the transition period from the liquid stat at high temperature to the solid state at normal temperature or ambient temperature. Various rapidly solidification processes have been developed and used, and a vacuum induction melting method, a squeeze casting method, a splat quenching method, a melt spinning method, a planer flow casting method, a laser or electron beam solidification method, and the like have been widely utilized, and all of these methods are characterized in that a solidified micro structure is formed through a rapid extraction of heat.

Prior to initiating the solidification, the rapid extraction of heat causes supercooling at a high temperature of 100° C. or more, and this is compared with a typical casting method accompanied by a temperature change of 1° C. or less per second. The cooling rate may be 5 to 10 K/s or more, 10 to $10^2$ K/s or more, $10^3$ to $10^4$ K/s or $10^4$ to $10^5$ K/s or more, and the rapidly solidification process is responsible for forming a solidified microstructure.

MnBi ribbons are continuously prepared by heating and melting a material with an MnBi alloy composition, and injecting the molten metal thereof from a nozzle and bringing the molten metal into contact with a cooling wheel rotating with respect to the nozzle to rapidly cool and solidify the molten metal.

In the present method of preparing a sintered magnet using a hybrid structure of the MnBi hard magnetic phase and the rare earth hard magnetic phase, in order to sinter the rare earth hard magnetic phase together which is usually difficult to sinter under 500° C., it is very important to prepare the MnBi ribbon by the rapidly solidification process (RSP) and secure microcrystalline characteristics of the MnBi ribbon. In an exemplary embodiment, when the crystal size on crystal grains of the MnBi ribbon prepared through the rapidly solidification process (RSP) of the present invention is 50 to 100 nm, high magnetic characteristics are obtained during the formation of the magnetic phase.

When the rapid cooling process is performed using a cooling wheel in the rapidly solidification process (RSP), the wheel speed may affect properties of the rapidly cooled alloy, and in general, in the rapidly solidification process using a cooling wheel, the faster the circumference speed of the wheel is, the greater cooling effect the material brought into contact with the wheel may obtain. According to an exemplary embodiment, the circumference speed of the wheel in the rapidly solidification process of the present invention may be 10 to 300 m/s or 30 to 100 m/s, and may be preferably 60 to 70 m/s.

The non-magnetic phase MnBi-based ribbon prepared may comprise non-magnetic phase in an amount of 90% or more, preferably 99% or more. If non-magnetic phase MnBi-based ribbon comprises 90% or more of non-magnetic phase, it is possible to inhibit rapid grain growth in the heat treatment for forming an MnBi low temperature phase (LTP), and to have uniform MnBi LTP.

(b) Converting Non-Magnetic Phase MnBi-Based Ribbon into Magnetic Phase MnBi-Based Ribbon The next step is a step of imparting magnetic properties to the prepared non-magnetic phase MnBi-based ribbon. According to an exemplary embodiment, a low heat treatment may be performed in order to impart magnetic properties, and for example, a magnetic phase Mn—Bi-based ribbon is formed by performing a low temperature heat treatment at a temperature of 280 to 340° C. under the vacuum and inert gas atmosphere conditions, and performing a heat treatment for 3 and 24 hours to induce diffusion of Mn included in the non-magnetic phase MnBi-based ribbon, and through this process, an MnBi-based magnetic body may be prepared. Through a heat treatment for forming an MnBi low temperature phase (LTP), the magnetic phase may be included in an amount of 90% or more, and more preferably 95% or more. When the MnBi low temperature phase is included in an amount of about 90% or more, the MnBi-based magnetic body may have excellent magnetic characteristics.

(c) Preparing Hard Magnetic Phase Powder

As the next step, an MnBi hard magnetic phase powder is prepared by pulverizing the MnBi low temperature phase MnBi alloy.

In the process of pulverizing the MnBi hard magnetic phase powder, the pulverization efficiency may be enhanced and the dispersibility may be improved preferably through a process using a dispersing agent. As the dispersing agent, a dispersing agent selected from the group consisting of oleic acid ($C_{18}H_{34}O_2$), oleyl amine ($C_{18}H_{37}N$), polyvinylpyrrolidone, and polysorbate may be used, but the dispersing agent is not limited thereto, and oleic acid may be included in an amount of 1 to 10 wt % with respect to the powder.

In the process of pulverizing the MnBi hard magnetic phase powder, a ball milling may be used, and in this case, the ratio of the ratio of a magnetic phase powder, balls, a solvent, and a dispersing agent is about 1:20:6:0.12 (by mass), and the ball milling may be performed by setting the balls to ϕ3 to ϕ5.

According to an exemplary embodiment of the present invention, the pulverization process using a dispersing agent composed of the MnBi hard magnetic phase powder may be performed for 3 to 8 hours, and the size of the MnBi hard magnetic phase powder completely subjected to LTP heat treatment and pulverization process as described above may be 0.5 to 5 μm in diameter. When the size exceeds 5 μm, the coercive force may be reduced.

Meanwhile, separately from the process of preparing the MnBi hard magnetic phase powder, a rare earth hard magnetic phase powder is also separately prepared.

In an exemplary embodiment, the rare earth hard magnetic phase may be represented by R—Co, R—Fe—B, or R—Fe—N (here, R is a rare earth element selected from the group consisting of Sc, Y, La, Ce, Pr, Nd, Pm, Sm, Eu, Gd, Tb, Dy, Ho, Er, Tm, Yb, and Lu), and may be preferably SmFeN, NdFeB, or SmCo.

The size of the rare earth hard magnetic phase powder completely subjected to pulverization process may be 1 to 5 μm. When the size exceeds 5 μm, the coercive force may be significantly reduced.

(d) Mixing MnBi Hard Magnetic Phase Powder with Rare Earth Hard Magnetic Phase Powder in the Presence of Lubricant In the step of mixing the MnBi hard magnetic phase with the rare earth hard magnetic phase, it is important to prepare a magnetic field molded body using a lubricant. In order to carry out the molding step (e) applying external magnetic filed and pressure prior to the subsequent sintering step (f), it is required to mix the powders using a lubricant.

When powder particles are mixed in the presence of a lubricant, the powder particles can be aligned filling the voids when external pressure is applied in the subsequent magnetic field molding step, whereas when there is no lubricant, the powder particles are broken during the magnetic field molding step when external pressure is applied, so that magnetic characteristics become deteriorated.

In the powder mixing step, the added lubricant components remain between powder particles, are evaporated and thermally decomposed during the subsequent sintering process, and thus are detected as carbon residue components present at the interface between particles in a final magnet.

Examples of the lubricant include ethyl butyrate, methyl caprylate, ethyl laurate, or stearates, and the like, and preferably, methyl caprylate, ethyl laurate, zinc stearate, and the like may be used. That is, in the case of methyl caprylate $(CH_2)_6$ and ethyl laurate $(CH_2)_{10}$ having relatively long molecular chains, and the like, characteristics of the magnetic field molded body are improved to bring an increase in density and residual induction value (Br) of the sintered magnet, thereby enhancing the maximum magnetic energy product.

It is further preferred that the lubricant is included in an amount of 1 to 10 wt %, 3 to 7 wt %, or 5 wt % with respect to the powder.

According to an exemplary embodiment, it is preferred that the process of mixing the MnBi hard magnetic phase with the rare earth hard magnetic phase is performed for the period between 1 minute and 1 hour, and it is preferred that the mixture is mixed maximally without pulverization.

(e) Carrying Out Magnetic Field Molding Applying External Magnetic Field and Pressure In the present step, the anisotropy is secured by orienting the magnetic field direction in parallel with the C-axis direction of the powder through a magnetic field molding process of applying external magnetic field and pressure. The anisotropic magnet which secures anisotropy in a uniaxial direction through the magnetic field molding as described above has excellent magnetic characteristics compared to isotropic magnets.

In particular, since the magnetic field molding is performed by applying external pressure during the magnetic field molding in the present step, atmospheric (normal pressure) sintering method can be adopted instead of pressure sintering method in the next step to prepare an anisotropic complex sintered magnet.

The magnetic field molding process of applying external magnetic field and pressure may be performed using a magnetic field injection molding machine, a magnetic field molding press, and the like, and may be performed using an axial die pressing (ADP) method, a transverse die pressing (TDP) method, and the like.

The magnetic field molding step may be performed under a magnetic field of 0.1 to 5.0 T, 0.5 to 3.0 T, or 1.0 to 2.0 T, and preferably about 1.6 T, and it is preferred for the atmospheric sintering which will be subsequently performed to perform the molding under a high pressure of 300 to 1,000 Mpa.

(f) Subjecting Molded Product to Atmospheric Sintering Process

In the related art, a high-performance sintered magnet may be prepared using a rapid sintering using hot press, and the like, but when the method suggested by the present invention is used, a high-performance sintered magnet may be prepared by atmospheric (normal pressure) sintering process, so that there is an advantage in that a heat treatment furnace in the sintered magnet process in the related art may be used.

The atmospheric sintering may be performed at 200 to 500° C. for 1 minute to 5 hours, and a continuous process using an atmospheric sintering furnace may be performed.

The anisotropic complex sintered magnet including the MnBi of the present invention may replace rare earth bond magnets in the related art because the low saturation magnetization value of MnBi is improved, high temperature stability is obtained, and excellent magnetic characteristics may be implemented. Further, since the anisotropic complex sintered magnet is prepared by an atmospheric sintering method, a continuous process may be enabled, and a sintering method used in the permanent magnet process in the related art is used as it is, so that the anisotropic complex sintered magnet is economical.

BRIEF DESCRIPTION OF THE DRAWINGS

FIG. 1 illustrates a schematic view of a process of preparing a complex sintered magnet of an MnBi hard magnetic phase powder/a rare earth hard magnetic phase powder according to an exemplary embodiment;

FIG. 2 illustrates a distribution analysis of MnBi and SmFeN by a scanning electron microscope (SEM) in the MnBi/SmFeN (30 wt %) complex sintered magnet;

FIG. 3 illustrates the residual flux density (Br) and maximum magnetic energy product [(BH)max] of the MnBi/SmFeN (30 wt %) complex sintered magnet according to the atmospheric sintering temperature (sintering time 6 minutes);

FIG. 4 illustrates the density and maximum magnetic energy product [(BH)max] of the MnBi/SmFeN (30 wt %) complex sintered magnet according to the atmospheric sintering temperature (sintering time 6 minutes); and FIG. 5 illustrates the result of an X-ray photoelectron spectroscopy (XPS) of the MnBi/SmFeN (30 wt %) normal sintered magnet.

MODES FOR CARRYING OUT THE PREFERRED EMBODIMENTS

Hereinafter, the present invention will be described in more detail through the Examples. These Examples are provided only for more specifically describing the present invention, and it will be obvious to a person with ordinary skill in the art to which the present invention pertains that the scope of the present invention is not limited by these Examples.

Example

Preparation of Anisotropic Complex Sintered Magnet Including MnBi

In accordance with the schematic view illustrated in FIG. 1, an anisotropic complex sintered magnet was prepared, and specifically, an MnBi ribbon was prepared by first setting the wheel speed in a rapidly solidification process (RSP) of preparing the MnBi ribbon to 60 to 70 m/s to form MnBi, Bi phases with a crystal size of 50 to 100 nm.

The non-magnetic phase MnBi-based ribbon prepared may comprise non-magnetic phase in an amount of 90% or more, preferably 99% or more. If non-magnetic phase MnBi-based ribbon comprises 90% or more of non-magnetic phase, it is possible to inhibit rapid grain growth in the heat treatment for forming an MnBi low temperature phase (LTP), and to have uniform MnBi LTP.

As the next step, a low temperature heat treatment was performed at a temperature of 280° C. under the vacuum and inert gas atmosphere conditions in order to impart magnetic properties to the prepared non-magnetic phase MnBi ribbon, a heat treatment was performed for 24 hours to induce diffusion of Mn included in the non-magnetic phase MnBi ribbon and form a magnetic phase MnBi-based ribbon, and through this, an MnBi-based magnetic body was prepared.

As a next step, a complex process was performed using the ball milling, and the pulverization process was performed for about 5 hours, the ratio of the magnetic phase powder, balls, a solvent, and a dispersing agent was about 1:20:6:0.12 (by mass), and the balls were set to ϕ3 to ϕ5.

Subsequently, the SmFeN hard magnetic body powder (30 wt %) was maximally mixed with the magnetic powder (70 wt %) prepared by the ball milling under methyl caprylate without being pulverized, a magnetic field molding was performed under the magnetic field of about 1.6 T while an external pressure of 700 Mpa was applied thereto, and then atmospheric sintering was performed at various temperatures belonging to 260° C. to 480° C. under normal pressure for 6 minutes to prepare a sintered magnet.

The cross-sectional state of the complex sintered magnet thus prepared was observed by a scanning electron microscope (SEM), and is illustrated in FIG. 2. In FIG. 2, it could be confirmed that a rare earth-free MnBi hard magnetic phase and a rare earth SmFeN hard magnetic phase were uniformly distributed.

Detection of Carbon Reside at Interface Between Particles of Anisotropic Complex Sintered Magnet The X-ray photoelectron spectroscopy (XPS) result of the MnBi/SmFeN (30 wt %) normal sintered magnet prepared above are illustrated in FIG. 5. Referring to FIG. 5, it can be confirmed that the content of carbon residue (C1s) was 37.8 at %, and the carbon residue was detected at a thickness of 10 nm from the surface.

Magnetic Characteristics and Density of Anisotropic Complex Sintered Magnet According to Atmospheric Sintering Temperature The intrinsic coercive force (HCi), residual flux density (Br), induced coercive force (HCB), density, and maximum magnetic energy product [(BH)max] of the MnBi/SmFeN (30 wt %) normal sintered magnet are shown, and the magnetic characteristics were measured at normal temperature (25° C.) using a vibrating sample magnetometer (VSM, Lake Shore #7300 USA, maximum 25 kOe), and the values are shown in the following Table and FIGS. 3 and 4.

TABLE 1

| Atmospheric sinteringtemperature (° C.) | HCl (kOe) | Br (kG) | HCB (kG) | Density (g/cm3) | (BH)max (MGOe) |
|---|---|---|---|---|---|
| 260 | 9.18 | 7.20 | 6.29 | 7.43 | 11.98 |
| 300 | 8.84 | 7.47 | 6.51 | 7.65 | 12.87 |
| 320 | 8.78 | 7.53 | 6.53 | 7.67 | 13.06 |
| 340 | 8.61 | 7.53 | 6.56 | 7.71 | 13.09 |
| 360 | 8.22 | 7.54 | 6.54 | 7.75 | 13.12 |
| 380 | 8.17 | 7.73 | 6.63 | 7.78 | 13.77 |
| 400 | 7.80 | 7.84 | 6.56 | 7.77 | 14.09 |
| 420 | 7.33 | 7.85 | 6.56 | 7.78 | 14.18 |
| 440 | 5.49 | 8.03 | 5.11 | 7.86 | 14.68 |
| 460 | 4.99 | 8.02 | 4.71 | 7.88 | 14.39 |
| 480 | 4.80 | 8.00 | 4.53 | 7.91 | 14.20 |

Referring to Table 1 ad FIG. 3, when prepared by the atmospheric sintering process at 440° C. for 6 minutes, the anisotropic complex sintered magnet of MnBi/SmFeN (30 wt %) anisotropic complex sintered magnet of the present invention exhibited a maximum magnetic energy product [(BH)max]measured value of 14.68 MGOe at 25° C. This is a result showing that a continuous process was enabled because a rapid sintering process using the hot press and the like was not used, and a high-performance complex sintered magnet may be prepared using a sintering method used in the permanent magnet process in the related art as it is. FIG. 4 is a result showing that as the atmospheric sintering temperature is increased, the intrinsic coercive force is decreased and the density is increased, an increase in density is a result that as the heat treatment temperature is increased, the size of crystal grains is increased to improve the densification of the sintered body, and a decrease in intrinsic coercive force is a result that due to the growth of crystal grains, the domain wall is increased.

The invention claimed is:

1. An atmospheric sintering method for preparing an anisotropic complex sintered magnet comprising MnBi, the method comprising:

(a) preparing a non-magnetic phase MnBi-based ribbon by a rapidly solidification process (RSP);

(b) subjecting the non-magnetic phase MnBi-based ribbon to a heat treatment to convert the non-magnetic phase MnBi-based ribbon into a magnetic phase MnBi-based ribbon;

(c) pulverizing the magnetic phase MnBi-based ribbon to prepare MnBi hard magnetic phase powders;

(d) mixing the MnBi hard magnetic phase powders with rare earth hard magnetic phase powders in the presence of a lubricant into a mixture;

(e) molding the mixture in a magnetic field by applying an external magnetic field and a pressure into a molded product; and (f) subjecting the molded product to an atmospheric sintering process, wherein the non-magnetic phase MnBi-based ribbon prepared in (a) has an average crystal grain size of 50 to 100 nm, and wherein the rapidly solidification process in the step (a) is performed with a wheel speed of 60 to 70 m/s.

2. The method of claim 1, wherein the lubricant is selected from the group consisting of ethyl butyrate, methyl caprylate, ethyl laurate, and stearates.

3. The method of claim 1, wherein the pressure applied in (e) is 300 to 1,000 Mpa.

4. The method of claim 1, wherein the atmospheric sintering process is performed in an atmospheric sintering furnace at a temperature of 200 to 500° C. for 1 minute to 5 hours.

5. The method of claim 1, wherein the heat treatment of (b) is performed at a temperature of 280 to 340° C.

6. The method of claim 1, wherein the MnBi hard magnetic phase powders have an average size of 0.5 to 5 μm, and the rare earth hard magnetic phase powders have an average size of 1 to 5 μm.

7. The method of claim 1, wherein during the process of pulverizing the magnetic phase MnBi-based ribbon in (c), a dispersing agent selected from the group consisting of oleic acid ($C_{18}H_{34}O_2$), oleyl amine ($C_{18}H_{37}N$), polyvinylpyrrolidone, and polysorbate is used.

8. The method of claim 1, wherein the non-magnetic phase MnBi-based ribbon prepared in (a) comprises a non-magnetic phase in an amount of 90% or more.

9. The method of claim 1, wherein in (d), a maximal amount of the rare earth hard magnetic phase powders that is mixed with the MnBi hard magnetic phase powders is 30 wt %.

* * * * *